US005885950A

United States Patent [19]

Dale et al.

[11] Patent Number: 5,885,950

[45] Date of Patent: Mar. 23, 1999

[54] COMPOSITION FOR CLEANING GREASE-TRAPS AND SEPTIC TANKS CONTROL

[75] Inventors: Parker Dale, Newport Beach; John E. Hill, Irvine, both of Calif.

[73] Assignee: Neozyme International, Inc., Newport Beach, Calif.

[21] Appl. No.: 789,932

[22] Filed: Jan. 28, 1997

Related U.S. Application Data

[60] Provisional application No. 60/010,896 Jan. 31, 1996.

[51] Int. Cl.[6] ..... C11D 3/386; C11D 3/30; C11D 3/18

[52] U.S. Cl. ..... 510/194; 510/195; 510/418; 510/421; 510/433; 510/530; 510/392; 210/606; 210/610; 210/613; 134/42

[58] Field of Search ..... 510/195, 418, 510/421, 433, 530, 194, 392; 210/606, 610, 613; 134/42

[56] References Cited

U.S. PATENT DOCUMENTS

| | | | |
|---|---|---|---|
| 2,424,049 | 7/1947 | Parker et al. | 134/3 |
| 3,404,068 | 10/1968 | Batistoni | 195/61 |
| 3,519,570 | 7/1970 | McCarty | 252/135 |
| 3,635,797 | 1/1972 | Battistoni et al. | 195/61 |
| 4,822,490 | 4/1989 | Dyadechko et al. | 210/601 |
| 5,071,765 | 12/1991 | Wiatr | 435/264 |
| 5,075,008 | 12/1991 | Chigusa et al. | 210/610 |
| 5,108,746 | 4/1992 | Rho et al. | 424/92.4 |
| 5,128,262 | 7/1992 | Lindoerfer et al. | 435/264 |
| 5,133,892 | 7/1992 | Chun et al. | 252/90 |
| 5,139,945 | 8/1992 | Liu | 435/232 |
| 5,227,067 | 7/1993 | Runyon | 210/606 |
| 5,326,477 | 7/1994 | Fugua et al. | 210/602 |
| 5,352,386 | 10/1994 | Rahman et al. | 252/548 |
| 5,352,387 | 10/1994 | Rahman et al. | 252/548 |
| 5,358,656 | 10/1994 | Humphreys et al. | 252/174.12 |
| 5,364,789 | 11/1994 | Guinn et al. | 435/262.5 |
| 5,369,031 | 11/1994 | Middleditch et al. | 435/284 |
| 5,372,944 | 12/1994 | Swanson | 435/252.1 |
| 5,385,685 | 1/1995 | Humphreys et al. | 252/174.17 |
| 5,389,279 | 2/1995 | Au et al. | 252/108 |
| 5,407,577 | 4/1995 | Nghiem | 210/606 |
| 5,466,396 | 11/1995 | Madison et al. | 252/557 |
| 5,492,629 | 2/1996 | Ludwig et al. | 210/698 |
| 5,503,766 | 4/1996 | Kulperger | 252/174.17 |
| 5,560,872 | 10/1996 | Rahman et al. | 510/392 |

OTHER PUBLICATIONS

A copy of International Search Report for related PCT Application No. PCT/US97/01391.

*Primary Examiner*—Kery Fries

*Attorney, Agent, or Firm*—Merchant, Gould, Smith, Edell, Welter & Schmidt

[57] ABSTRACT

A composition and methods for cleaning grease-traps, septic tank control, discharge water from industrial meat and poultry processing and packing plants, lift stations and municipal systems. The composition comprises preservatives at a concentration of about 0.35%, by weight, a non-ionic surfactant at a concentration of about 8%, by weight, triethanolamine at a concentration of about 2%, by weight and a fermentation supernatant at a concentration of about 12.14%, by weight. In a preferred embodiment of the present invention the composition comprises a fermentation supernatant from a *Saccharomyces cerevisiae* culture, sodium benzoate, imidazolidinyl urea, diazolidinyl urea, triethanolamine and a polyoxyethlene alcohol surfactant.

6 Claims, No Drawings

COMPOSITION FOR CLEANING GREASE-TRAPS AND SEPTIC TANKS CONTROL

RELATED APPLICATIONS

This application is based on Provisional Application Ser. No. 60/010,896 filed Jan. 31, 1996, which is incorporated herein by reference.

FIELD OF THE INVENTION

The present invention is directed at a biologically based composition for cleaning and deodorizing grease-traps, septic tank control, discharge water from industrial meat and poultry processing and packing plants, lift stations and municipal systems.

BACKGROUND OF THE INVENTION

Many manufacturing, food processing and industrial facilities dispose of liquid waste into sewer lines. The liquid waste often contains fats, oils and grease (FOG) and other organic contaminants which, over time, leads to clogs in pipes. The treatment of this problem is to clean pipes with caustic drain cleaners, mechanically rout the pipes or to replace the pipes completely. Even when grease-traps are included in a drainage system, the grease-traps can form a permanent, solid grease layer over the top of the water in the grease-trap which requires "pump-out" of the grease-trap.

In other situations, liquid waste is disposed into septic tanks and drain-fields. High concentrations of FOG in the waste water can lead to grease build-up on rocks in the drain-field which eventually form a seal over the rocks preventing water flowing into the drain-field. The treatment of this problem requires digging out the drain-field and replacing it with new materials.

A number of biological processes and compositions have been developed which are directed at specific contaminants, for example: *Xanthomonas maltophilia* and *Bacillus thuringiensis* have been used to degrade polar organic solvents (U.S. Pat. No. 5,369,031); a combination of amylase, lipase and/or protease have been used to digest colloidal material such as starch, grease, fat and protein (U.S. Pat. No. 5,882,059); and a yeast fermentation composition described in U.S. Pat. No. 3,635,797 has been described as effective in deodorizing sewage and ponds and in the degradation of organic waste. However, some compositions, such as that described in U.S. Pat. No. 3,635,797 have been found to be unstable and yielded variable results from one batch to another. Other compositions described above are directed at only a specific contaminant and do not address the problems presented by waste containing high FOG.

It is desirable to provide a non-toxic and non-polluting composition for emulsification and digestion of fats, oils and grease and other organic contaminants that clog pipes. It is also desirable that the use of such a composition avoids the need for pump-outs of grease-traps and septic tanks and the replacement of drain-fields. It is also desirable that such a composition remove odors emitted from such grease-traps, drains, septic tanks, discharge water from industrial meat and poultry processing and packing plants, lift stations and municipal systems.

SUMMARY OF THE INVENTION

The present invention is directed at a composition for cleaning grease-traps, septic tank control, discharge water from industrial meat and poultry processing and packing plants, lift stations and municipal systems. The composition comprises preservatives at a concentration of about 0.35%, by weight, a non-ionic surfactant at a concentration of about 8%, by weight, triethanolamine at a concentration of about 2%, by weight and a fermentation supernatant at a concentration of about 12.14%, by weight.

In a preferred embodiment of the present invention the composition comprises a fermentation supernatant from a *Saccharomyces cerevisiae* culture, sodium benzoate, imidazolidinyl urea, diazolidinyl urea, triethanolamine and a polyoxyethlene alcohol surfactant.

DETAILED DESCRIPTION

The present invention is directed at a composition for cleaning organic material from surfaces.

Oxidative biological and chemical processes in aqueous environments are limited by the low solubility of oxygen in water. This physical limitation is defined by Henry's Law. It states that when the temperature is kept constant, the amount of a gas that dissolves into a liquid is proportional to the pressure exerted by the gas on the liquid.

The solubility of oxygen in pure water is only about 10 parts per million (ppm) at ambient temperatures and at one atmosphere pressure. The composition of the present invention has been observed to increase oxygen in water above levels which would be anticipated by Henry's Law.

For most aerobic bioprocesses, whether a wastewater treatment system or a biotechnology fermentation, dissolved oxygen is quickly consumed so that replenishing it becomes the factor which limits the rate of the process. Therefore, the most critical component of a bioprocess design is the means for the mass transfer of oxygen into the liquid phase of the process. For an actively respiring culture of bacteria at a cell density of about $10^9$ cells/ml, oxygen in the liquid medium must be replaced about 12 times per minute to keep up with the oxygen demand of the bacteria.

Water is typically aerated by increasing the contact surfaces between the gaseous and liquid phases. This can be done either by introducing a source of oxygen into a bulk liquid phase or by flowing dispersed water through a bulk gaseous (air) phases. Regardless of whether the gaseous or liquid phases dominate the oxygenation process, the mass transfer of oxygen, or other gas, is accomplished by introducing gas bubbles into the liquid phase. The efficiency of gas-liquid mass transfer depends to a large extent on the characteristics of the bubbles. Bubble behavior strongly affects the following mass-transfer parameters:

Transfer of oxygen from the interior of the bubble to the gas-liquid interface;

Movement of oxygen across the gas-liquid interface; and

Diffusion of oxygen through the relatively stagnant liquid film surrounding the bubble.

It is of fundamental importance in the study of bubbles to understand the exchange of gases across the interface between the free state within the bubble and the dissolved state outside the bubble. It is generally agreed that the most important property of air bubbles in a bioprocess is their size. For a given volume of gas, more interfacial area (a) between the gas phase and liquid phase is provided if the gas is dispersed into many small bubbles rather than a few large ones. Small bubbles, 1–3 mm, have been shown to have the following beneficial properties not shared by larger bubbles:

Small gas bubbles rise more slowly than large bubbles, allowing more time for a gas to dissolve in the aqueous phase. This property is referred to as gas hold-up, concentrations of oxygen in water can be more than doubled beyond Henry's Law solubility limits. For example, after a saturation limit of 10 ppm oxygen is attained; at least another 10 ppm oxygen within small bubbles would be available to replenish the oxygen.

Once a bubble has been formed, the major barrier for oxygen transfer to the liquid phase is the liquid film surrounding the bubble. Biochemical engineering studies have concluded that transport through this film becomes the rate-limiting step in the complete process, and controls the overall mass-transfer rate. However, as bubbles become smaller, this liquid film decreases so that the transfer of gas into the bulk liquid phase is no longer impeded.

Surfactants in water can lead to the formation of very small bubbles, less than 1 mm in diameter. These small bubbles, referred to as microbubbles, are the result of the reduced surface tension at the interface between the gas/liquid interface caused by surfactants.

As large concentrations of gas are introduced into a solution such as by a chemical reaction or other mechanism, the liquid phase can become supersaturated if nucleation centers for the formation of bubbles are absent. At this point microbubbles can then form spontaneously, nucleating large bubble formation, and sweeping dissolved gases from the solution until supersaturation again occurred. In the presence of surfactants, it is likely that a larger portion of gas would remain in the solution as stable bubbles.

Microbubbles exposed to a dispersion of gas in a liquid show colloidal properties and are referred to as colloidal gas aphrons (CGA). CGA differ from ordinary gas bubbles in that they contain a distinctive shell layer consisting of a low concentration of a surfactant.

The composition of the present invention exhibits desirable properties associated with surfactant microbubbles. However, the microbubbles formed with the composition of the present invention appear to increase the mass transfer of oxygen in liquids. Without being bound by scientific theory, there are several possible explanations for this difference:

The earlier described surfactant microbubbles involved the use of pure synthetic surfactants that were either anionic or cationic. The surfactants formulated into the composition of the present invention are nonionic and are blended with biosurfactants which significantly alter the properties of bubble behavior.

The composition of the present invention requires a much lower concentration of surfactants for microbubble formation. It has been suggested that surfactant concentrations must approach the critical micelles concentration (CMS) of a surfactant system. In the composition of the present invention, microbubbles are formed below estimated CMCs for the surfactants used. This suggests that the composition of the present invention microbubbles are the result of aggregates of surfactant molecules with a loose molecular packing more favorable to gas mass transfer characteristics. A surface consisting of fewer molecules would be more gas permeable than a well-organized micelle containing gas.

In addition to surfactants, the composition of the present invention contains biologically derived catalysts. Both of these components tend to be amphiphilic, that is they have pronounced hydrophobic and hydrophilic properties. Amphiphilic molecules tend to cluster in water to form allow molecular weight aggregates which (as surfactant concentrations increase) result in micelle formation at concentrations ranging from $10^{-2}$ to $10^{14}$M. Aggregates of these amphiphilic molecules are the nuclei for microbubble formation.

The composition of the present invention appears to increase oxygen levels in fluids. Without being bound by scientific theory, it is believed this effect can be explained by either or both of two mechanisms:

Increased mass transfer of gases resulting from the interactions of non-ionic surfactants and other components of the composition of the present invention; and Delayed release of gases from microbubbles so that oxygen can be dispersed throughout a liquid rather than just at the point of introduction.

With either mechanism, it is likely that the tendency of composition of the present invention organizes into clusters, aggregates, or gas-filled bubbles provides a platform for reactions to occur by increasing localized concentrations of reactants, lowering the transition of energy required for a catalytic reaction to occur, or some other mechanism which has not yet been described. It has been established that the non-ionic surfactants used in the composition of the present invention are compatible with and enhance enzymatic reactions.

The composition of the present invention has catalytic activities that is more like the catalytic activities of functionalized surfactants than conventional enzyme systems.

The composition comprises a yeast fermentation supernatant, preservatives and a non-ionic surfactant, in the absence of an anionic or cationic surfactant.

Non-ionic surfactants suitable for use in the present invention include, but are not limited to, polyether non-ionic surfactants comprising fatty alcohols, alkyl phenols, fatty acids and fatty amines which have been ethoxylated; polyhydroxyl non-ionic (polyols) typically comprising sucrose esters, sorbital esters, alkyl glucosides and polyglycerol esters which may or may not be ethoxylated. In one embodiment of the present invention the surfactant is a polyoxyethlene alcohol surfactant such as those sold under the tradename TERGITOL (Union Carbide Chemicals and Plastic Co., Inc.) and in particular TERGITOL 15-S-7. TERGITOL acts synergistically to enhance the action of the yeast fermentation product.

The fermentation supernatant of the present invention is similar to that described in U.S. Pat. No. 3,635,797 to Battistoni et al., which is incorporated herein by reference. Briefly, yeast, *Saccharomyces cerevisiae*, is cultured in a medium comprising: a sugar source, such as sucrose from molasses or raw sugar, soy beans or mixtures thereof, a sugar concentration of about 10 to 30%, by weight, is used; malt such as diastatic malt is used at a concentration of about 7 to 12%, by weight; a salt, such as magnesium salts, and in particular magnesium sulfate, is used at a concentration of about 1 to 3%, by weight, and yeast is added to the medium to a final concentration of about 1 to 5%, by weight.

The mixture is incubated at about 26° to 42° C. until the fermentation is completed, i.e. until effervescence of the mixture has ceased, usually about 2 to 5 days depending on the fermentation temperature. At the end of the fermentation the yeast fermentation product is centrifuged to remove the "sludge" formed during the fermentation.

The supernatant (about 98.59%, by weight) is mixed with sodium benzoate (about 1%, by weight), imidazolidinyl urea (about 0.01%, by weight), diazolidinyl urea (about 0.15%, by weight), calcium chloride (about 0.25%, by weight) to form fermentation intermediate. The pH is adjusted to about 3.7 to about 4.2 with phosphoric acid. The composition of the fermentation intermediate is summarized in Table I.

TABLE I

| Fermentation Intermediate | |
|---|---|
| Component | %, by weight |
| Fermentation supernatant | 98.59 |
| Na benzoate | 1 |
| Imidazolidinyl urea | 0.01 |
| Diazolidinyl urea | 0.15 |
| Calcium chloride | 0.25 |
| Adjust pH | to about 3.7 to about 4.2 with phosphoric acid |

The fermentation intermediate is prepared by filling a jacketed mixing kettle with the desired quantity of the fermentation supernatant. With moderate agitation the pH is adjusted to 3.4 to 3.6 with phosphoric acid. With continuous agitation sodium benzoate, diazolidinyl urea, imidazolidinyl urea and calcium chloride are added. The temperature of the mixture is then slowly raised to about 40° C. and the mixture is agitated continuously. The temperature is maintained at about 40° C. for about one hour to ensure that all the components of the mixture are dissolved. The mixture is then cooled to about 20° to 25° C.

The fermentation intermediate is then formulated into the composition of the present invention (final composition). Fermentation intermediate (about 12.31%, by weight, of the final composition) is mixed with a nitrogen containing compound such as urea, ammonium nitrate or mixtures thereof (about 9%, by weight, final composition), preservatives such as sodium benzoate (about 0.1%, by weight, of the final composition),imidazolidinyl urea (about 0.01%, by weight, of the final composition), diazolidinyl urea (about 0.15%, by weight, of the final composition) and mixtures thereof, a surfactant such as TERGITOL 15-S-7 (about 8%, by weight, of the final composition), triethanolamine (about 2%, by weight, of the final composition), and the composition is brought to 100% with water.

In a preferred embodiment the composition of the present invention comprises about 12.31%, by weight, fermentation intermediate, about 9%, by weight, ammonium nitrate, about 0.01%, by weight, about 0.1%, by weight, sodium benzoate, imidazolidinyl urea, about 0.15%, by weight, diazolidinyl urea, about 2%, by weight, triethanolamine, about 8%, by weight, of a surfactant such as TERGITOL 15-S-7 and about 67.53%, by weight, water (see Table II).

TABLE II

| Final Composition | |
|---|---|
| Component | %, by weight |
| Tergitol 15-S-7 | 8 |
| Sodium benzoate | 0.1 |
| Imidazolidinyl urea | 0.01 |
| Diazolidinyl urea, | 0.15 |
| Triethanolamine | 2 |
| Fermentation Intermediate | 12.31 |

The method for preparing the final composition is to charge a mixing kettle with the desired volume of water at 20° to 25° C. The preservatives are added to the water with agitation. TERGITOL 15-S-7 is then added and the mixture is blended until the solids are dissolved. Triethanolamine is then added and the mixture is blended until the solids are dissolved. The fermentation intermediate is then added with gentle agitation. The pH is adjusted to about 8.5 to 9 with phosphoric acid.

The final concentration of components in the final composition are summarized in Table III.

TABLE III

| Final Composition | |
|---|---|
| Component | %, by weight |
| Na benzoate | 0.19 |
| Imidazolidinyl urea | 0.01 |
| Diazolidinyl urea | 0.15 |
| Tergitol 15-S-7 | 8 |
| Calcium chloride | 0.03 |
| Triethanolamine | 2 |
| Fermentation supernatant | 12.14 (clarified) |
| Adjust pH | to about 8.5 to 9 with phosphoric acid |

The final composition is diluted for use. For use in grease-traps the final composition is diluted to a final concentration in the grease-trap of about 1:150 for an initial treatment. After the initial treatment the final composition is diluted to a final concentration in the grease-trap of about 1:600. The final composition, diluted about 1:600, is then added about every two weeks to maintain the grease-trap in a free-flowing and odorless condition.

For use in septic tanks the final composition is diluted to a final concentration in the septic tank of about 1:800 for an initial treatment. After the initial treatment the final composition is diluted to a final concentration in the septic tank of about 1:12,000 and is then added every week to maintain the septic tank.

For use in drain-fields about two gallons of the final composition is diluted with sufficient water to cover about 400 square feet of field area. The area is then thoroughly watered, with plain water, to wash the final composition into the drain-field. The treatment is repeated after four days, if needed. The treatment can be repeated periodically as required.

For use in drains, about one quart of the final composition is added to the drains to be treated, followed by a gallon of warm water (about 40° to 50° C.). Drains on lower floors should be treated first and then drains on upper floors. The treatment is repeated as required to maintain free-flowing drains.

For use in lift stations and wet wells, to dissolve and prevent formation of grease caps, the final composition is diluted to a final concentration in the lift stations or wet wells of about 1:10 for an initial treatment. After the initial treatment the final composition is diluted to a final concentration in the lift stations or wet wells of about 1:1,000 and is then added about every four weeks to maintain the lift stations or wet wells.

Those skilled in the art are aware that dilutions of such compositions can be used and that over-dilution for a particular purpose can result in a decreased rate of digestion and therefore, effectiveness of the composition and that under-dilution for a particular purpose increases cost without increasing the rate of degradation or effectiveness. Ideally, the final composition is diluted to optimize the rate of degradation or effectiveness and to minimize costs.

EXAMPLE 1

Comparison of the Fermentation Intermediate of U.S. Pat. No. 3,635,797 and the Final Compound of the Present Invention The present invention is a modification of the fermentation composition described in U.S. Pat. No. 3,635,797.

The fermentation intermediate of U.S. Pat. No. 3,635,797 and the composition of the present invention are set forth for comparison in Table IV.

TABLE IV

| Component | U.S. Pat. No. 3,635,797 (%, by weight) | Final Composition (%, by weight) |
|---|---|---|
| Na benzoate | 0 | 0.19 |
| Imidazolidinyl urea | 0 | 0.01 |
| Diazolidinyl urea | 0 | 0.15 |
| Anionic surfactants | 20 | 0 |
| Nonionic surfactants | 18 | 8 |
| Cationic surfactants | 25 | 0 |
| Lactic acid | 9 | 0 |
| Citric acid | 1.7 | 0 |
| Urea | 40 | 0 |
| Pine oil | 3.5 | 0 |
| Calcium chloride | 0 | 0.03 |
| Triethanolamine | 0 | 2 |
| Fermentation super. | 22 | 12.14 (clarified) |
| Adjust pH | about 3.0 (citric acid) | about 8.5 to 9 ($H_3PO_4$) |

The elimination of anionic surfactants and cationic surfactants increased the performance of the final formulation in its ability to degrade oils, fats and grease. The addition of imidazolidinyl urea, diazolidinyl urea and sodium benzoate increased the stability of the final formulation by inhibiting degradation of the fermentation supernatant. Centrifugation to form the fermentation supernatant resulted in a decrease of particulate matter which resulted in residue which can contribute to clogging of pipes.

EXAMPLE 2

Treatment of Restaurant Grease Trap Collections

An efficacy trial was run with the composition of the present invention to treat restaurant grease trap collections. Twenty gallons of the composition of the present invention (12.31%, by weight, fermentation intermediate, 12.31%, by weight, urea, 8%, by weight, TERGITOL 15-S-7, 2%, by weight, triethanolamine) was mixed with 3,000 gallons of grease trap contents gathered from restaurants.

Analysis of the grease trap contents prior to treatment showed the FOG to be 18,000 mg/l and TSS (Total Suspended Solids) to be 19,400 mg/l. After the composition was added air was introduced and the solution was mixed for 24 hours. At the end of the 24 hours a sample was taken and analyzed. The results showed that the FOG decreased to 160 mg/l and the TSS reduced to 410 mg/l.

EXAMPLE 3

Bench Scale Test of Treatment of Prepared FOG Sample

A FOG sample containing 33% tallow, 33% vegetable fat, and 33% lard was prepared. Two grams of the FOG sample was added to each of two 450 ml aliquots of water. Three ml of the composition of the present invention was added to one of the FOG/water samples. The FOG/water (control) and FOG/water/composition (test) samples were stirred for 24 hours at room temperature. After 24 hours each of the samples were analyzed for the fat remaining in the samples.

Treatment with the composition of the present invention resulted in approximately a 50% reduction in the fat content of the test sample compared to the control sample.

The present invention is not to be limited to the specific embodiments shown which are merely illustrative. Various and numerous other embodiments may be devised by one skilled in the art without departing from the spirit and scope of this invention.

What is claimed is:

1. A composition for cleaning grease-traps, septic tank control, discharge water from industrial meat and poultry processing and packing plants, lift stations and municipal systems comprising: preservatives at a concentration of about 0.35%, by weight, a non-ionic surfactant at a concentration of about 8%, by weight, triethanolamine at a concentration of about 2%, by weight and a fermentation supernatant from *Saccharomyces cerevisiae* at a concentration of about 12.14%, by weight.

2. A composition as recited in claim 1 wherein the composition is use at a concentration of about 1:10 to 1:800 in the water to be treated for initial treatment of the grease-traps, septic tank control, discharge water from industrial meat and poultry processing and packing plants, lift stations and municipal systems to be treated.

3. A composition as recited in claim 1 wherein the composition is used at a concentration of about 1:600 to 1:12,000 in the water to be treated for maintenance treatment of the grease-traps, septic tank control, discharge water from industrial meat and poultry processing and packing plants, lift stations and municipal systems to be treated.

4. A composition as recited in claim 1 wherein the preservatives are selected from the group consisting of sodium benzoate, imidazolidinyl urea, diazolidinyl urea, methyl paraben, propyl paraben and mixtures thereof.

5. A composition according to claim 1 which further comprises ammonium nitrate.

6. A method of cleaning grease-traps by contacting said grease traps with a composition comprising a preservative at a concentration of about 0.35% by weight, a non-ionic surfactant at a concentration of about 8% by weight, triethanolamine at a concentration of about 2%, by weight and a fermentation supernatant from Saccharomyces cerevisiae at a concentration of about 12.14%.

* * * * *

UNITED STATES PATENT AND TRADEMARK OFFICE

CERTIFICATE OF CORRECTION

PATENT NO. : 5,885,950

DATED : MARCH 23, 1999

INVENTOR(S) : DALE ET AL.

It is certified that error appears in the above-identified patent and that said Letters Patent is hereby corrected as shown below:

On the title page: Item

[56] References Cited, U.S. Patent Documents: insert the following patents in numerical order:

| | | | |
|---|---|---|---|
| —3,880,739 | 04/1975 | Leavitt | 195/28— |
| —4,009,119 | 2/1977 | Poschmann et al. | 252/358— |
| —4,127,447 | 11/1978 | Griffith et al. | 195/116— |
| —4,541,944 | 9/1985 | Sanderson | 252/95— |
| —5,041,236 | 8/1991 | Carpenter et al. | 252/174.12— |
| —5,160,488 | 11/1992 | Stillman | 435/262.5— |
| —5,520,835 | 5/1996 | Sivik et al. | 252/102— |

Item [56], References Cited, Other Publications: after "PCT/US97/01391." insert a new paragraph, then the following two paragraphs:

—A copy of International Search Report for related PCT Application No. PCT/US97/01551.

A copy of International Search Report for counterpart PCT Application No. PCT/US97/01616.—

Signed and Sealed this

Twenty-ninth Day of February, 2000

*Attest:*

Q. TODD DICKINSON

*Attesting Officer*

*Commissioner of Patents and Trademarks*